US006339383B1

(12) United States Patent
Kobayashi et al.

(10) Patent No.: US 6,339,383 B1
(45) Date of Patent: Jan. 15, 2002

(54) TRAFFIC SIGNAL CONTROL APPARATUS OPTIMIZING SIGNAL CONTROL PARAMETER BY ROLLING HORIZON SCHEME

(75) Inventors: Masafumi Kobayashi, Osaka; Tsutomu Usami, Tokyo; Toshifumi Oota, Osaka, all of (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/704,574

(22) Filed: Nov. 3, 2000

(30) Foreign Application Priority Data

Nov. 5, 1999 (JP) ..... 11-315349

(51) Int. Cl.[7] ..... G08G 1/00

(52) U.S. Cl. ..... 340/907; 340/909; 340/910; 340/917; 701/117

(58) Field of Search ..... 340/907, 909, 340/910, 916, 917; 701/117, 118, 119

(56) References Cited

U.S. PATENT DOCUMENTS 5,444,442 A * 8/1995 Sadakata et al. ..... 340/916
5,555,444 A * 9/1996 Diekelman et al. ..... 455/12.1
5,798,949 A * 8/1998 Kaub ..... 395/500.27

FOREIGN PATENT DOCUMENTS

JP 6-266993 9/1994
JP 7-6292 1/1995
JP 11-126296 5/1999

OTHER PUBLICATIONS

"Utopia", V. Mauro et al., Control, Computers, Communications in Transportation, Selected Papers from the IFAC/IFIP/IFORS Symposium, Sep. 19–21, 1989, Paris, France, pp. 245–252.

"Simulation Study of OPAC: A Demand–Responsive Strategy for Traffic Signal Control", H. Chen et al., Proceedings of the Tenth International Symposium on Transportation and Traffic Theory, Jul. 8–10, 1987, Cambridge, Massachusetts, pp. 236–238.

* cited by examiner

*Primary Examiner*—Edward Lefkowitz
(74) *Attorney, Agent, or Firm*—McDermott, Will & Emery

(57) ABSTRACT

In a traffic signal control apparatus that can correspond to sudden change in the traffic status, traffic information is collected from a sensor provided at the road to obtain the status of a street intersection from the past to the future as profile data. By the rolling horizon scheme, optimization of the signal timing is carried out. The collect cycle of traffic information and the cycle of optimization are defined independently, and the cycle of optimization is set variable according to the cycle of signal control or the traffic status.

18 Claims, 10 Drawing Sheets

TRAFFIC SIGNAL CONTROL APPARATUS OPTIMIZING SIGNAL CONTROL PARAMETER BY ROLLING HORIZON SCHEME

BACKGROUND OF THE INVENTION

1. Field of the Invention

The present invention relates to traffic signal control apparatuses, particularly a traffic signal control apparatus that can handle off-peak traffic up to over-heavy traffic by predicting change in the traffic status from the present to the future to optimize the signal control parameter by the rolling horizon scheme up to the status of near-saturation and executing politic control in the status of over-saturation.

2. Description of the Background Art

Conventional traffic signal control apparatuses are known that calculate the signal control parameter (cycle, split, offset) by a central device to control signal terminals.

When there is a sudden change in the traffic status, the timing of altering the signal control parameters is delayed in the conventional traffic signal control apparatus. There are cases where a great jam in traffic occurs.

SUMMARY OF THE INVENTION

An object of the present invention is to provide a traffic signal control apparatus that can correspond to a sudden change in the traffic status.

According to an aspect of the present invention, a traffic signal control apparatus includes a collector unit collecting traffic information through a sensor provided at the road, and an optimization unit predicting change in the traffic status from the present to the future and optimizing the signal control parameter by the rolling horizon scheme. The collecting cycle of traffic information and the optimization cycle can be defined independently. The optimization cycle can be made variable according to the cycle of signal control or the traffic status.

According to the present invention, the rolling horizon scheme is employed. Since the traffic information collecting cycle and optimization cycle can be defined independently, and since the optimization cycle according to the signal control cycle or the traffic status is set variable, a traffic signal control apparatus that can correspond to sudden change in traffic status can be provided.

Preferably, the traffic signal control apparatus carries out optimization of a signal control parameter individually for each street intersection while maintaining the integrity of the entire network by exchanging the traffic information and signal control contents between adjacent street intersections.

By exchanging the traffic information and signal control contents between adjacent street intersections, a traffic signal control apparatus more adaptable to practical usage can be provided.

Preferably, the traffic signal control apparatus further includes a unit predicting the tiring of a vehicle from the present to future traffic volume arriving at the stop line using a traffic flow measurement unit installed upstream a link and expected flow-in traffic volume obtained from an upstream street intersection.

By predicting the timing of a vehicle from the present to future traffic volume arriving at the stop line using the expected flow-in traffic volume, a traffic signal control apparatus of better control can be provided.

Preferably, the traffic signal control apparatus has the function to realize signal control taking into consideration individually or simultaneously reduction of the risk of a traffic accident, influence to the environment, and reducing the number of stops of a bus and other public transportation at a traffic signal.

By realizing signal control taking into consideration the risk of a traffic accident and the like, a traffic signal control apparatus that can provide better control of the traffic signal can be provided.

Preferably, the traffic signal control apparatus has the self correction function to correct the estimated expected flow-out amount by the relationship between the history of the traffic signal light color and the traffic volume measured by the traffic flow measurement device of the flow-out destination link.

According to the present invention, a traffic signal control apparatus that can correct the estimated expected flow-out amount can be provided.

Preferably, the traffic signal control apparatus has the-function to correct the estimated traffic jam length according to the traffic jam length measured by an image sensor or the traffic jam length calculated from traffic information obtained from a traffic flow measurement device.

According to the present invention, a traffic signal control apparatus that can correct the estimated traffic jam length can be provided.

Preferably, the traffic signal control apparatus has the function to alter the weight coefficient of each cost element of the evaluation function of the signal control parameter according to the traffic status, region characteristics and control target.

According to the present invention, a traffic signal control apparatus that can alter the weight coefficient of each cost element of the evaluation function of a signal control parameter can be provided.

Preferably, the traffic signal control apparatus has the function to switch the control target from cost minimization to handling amount maximization, or to switch to priority control giving a particular direction priority when vehicles of a traffic demand exceeding the street intersection processing ability flows to the intersection.

According to the present invention, a traffic signal control apparatus that can switch the control target according to the status can be provided.

Preferably, when excessive traffic jam occurs locally at some links, the traffic signal control apparatus has the function to expedite the processing amount of these links by alleviating the blue traffic light time maximum restriction and setting the weight coefficient of a downstream delay which is one cost element to zero.

According to the present invention, a traffic signal control apparatus can be provided capable of facilitating the processing amount of a link when local excessive traffic jam occurs.

Preferably, the traffic signal control apparatus includes a unit switching the signal control method according to each traffic status of nonsaturation, near-saturation and over-saturation, in an abnormal status, or in response to an instruction.

According to the present invention, a traffic signal control apparatus that can switch the signal control method according to the traffic status, an abnormal status, or in response to an instruction can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A traffic signal control apparatus according to an embodiment of the present invention will be described hereinafter.

The problem in the existing signal control system is that there is delay in following the change in the traffic status. When there is a sudden change in the traffic status, the timing of altering the signal control parameter (cycle, split, offset) is delayed to induce a heavy traffic jam.

In the present embodiment, the signal control plan is optimized dynamically according to the future expected traffic change status. The signal control of the present embodiment modifies the signal control parameter flexibly according to change in the traffic status in contrast to the conventional control where execution is provided at a constant cycle.

Figure 1:
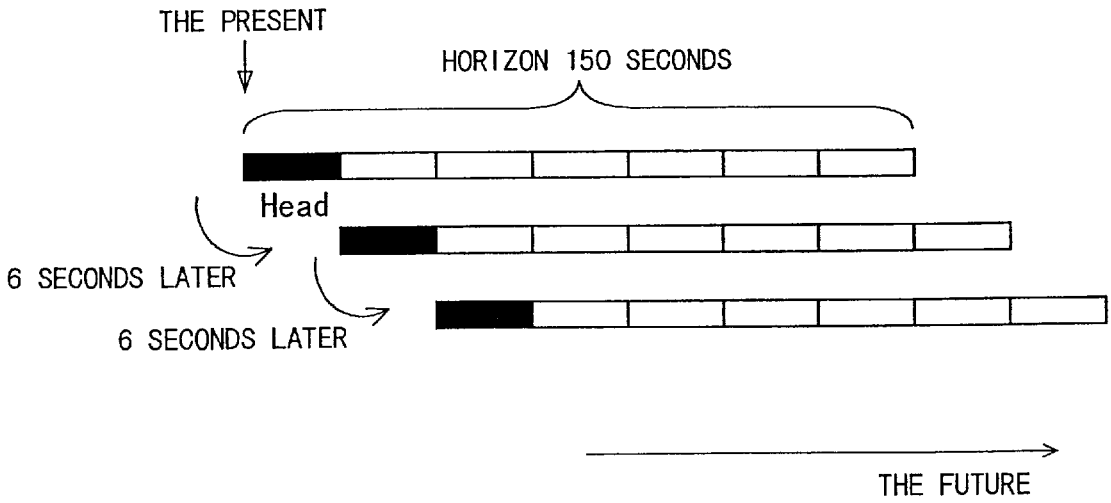
FIG. 1 is a diagram to describe the rolling horizon scheme.

More specifically, the signal control system that is currently available updates the signal control parameter for every five or 2.5 minutes based on data measured by a sensor in the past. In the present embodiment, the rolling horizon scheme is employed for the optimization method. The signal control plan is optimized dynamically for every several seconds according to the future expected traffic change status. The rolling horizon scheme is the optimization method employed in the field of operation research under the circumstance where the future status is uncertain. Referring to FIG. 1, the scheme is characterized in that: "optimization is executed according to the status estimate within a limited optimization range (horizon) from the present to the future of several minutes" and "optimization calculation is executed for every several seconds (here, 6 seconds)." In other words, the optimum solution is updated as occasion calls while shifting (rolling) the optimization range horizon) according to newly collected traffic information.

As a result, signal control according to the calculated optimum solution is executed for just a period of several seconds. Accordingly, dynamic correspondence is allowed according to the status that is ever changing. In the present embodiment, the control mode is modified according to the traffic status. By carrying out politic signal control particularly in the over-saturation status, traffic of nonsaturation to over-saturation can be handled.

Also, control taking into account reduction of a traffic accident and environment (reducing traffic noise, gaseous emission, and the like) can be realized in the present embodiment. Furthermore, reducing the number of stops of a public transportation such as a bus can be taken into consideration.

In the signal control algorithm of the present embodiment, optimization is executed for every unit of seconds (for example, 6 seconds). It is assumed that the optimization calculation is directed to the range from the present to the future of 150 seconds (horizon). In the system of the present embodiment, the optimization cycle is set variable according to the traffic status and control status such as increasing the optimization cycle during the day time of a weekday where the traffic status is stable or in a time zone where the green light cannot be forced to red light since the green light time is within the shortest restriction range.

Figure 2:
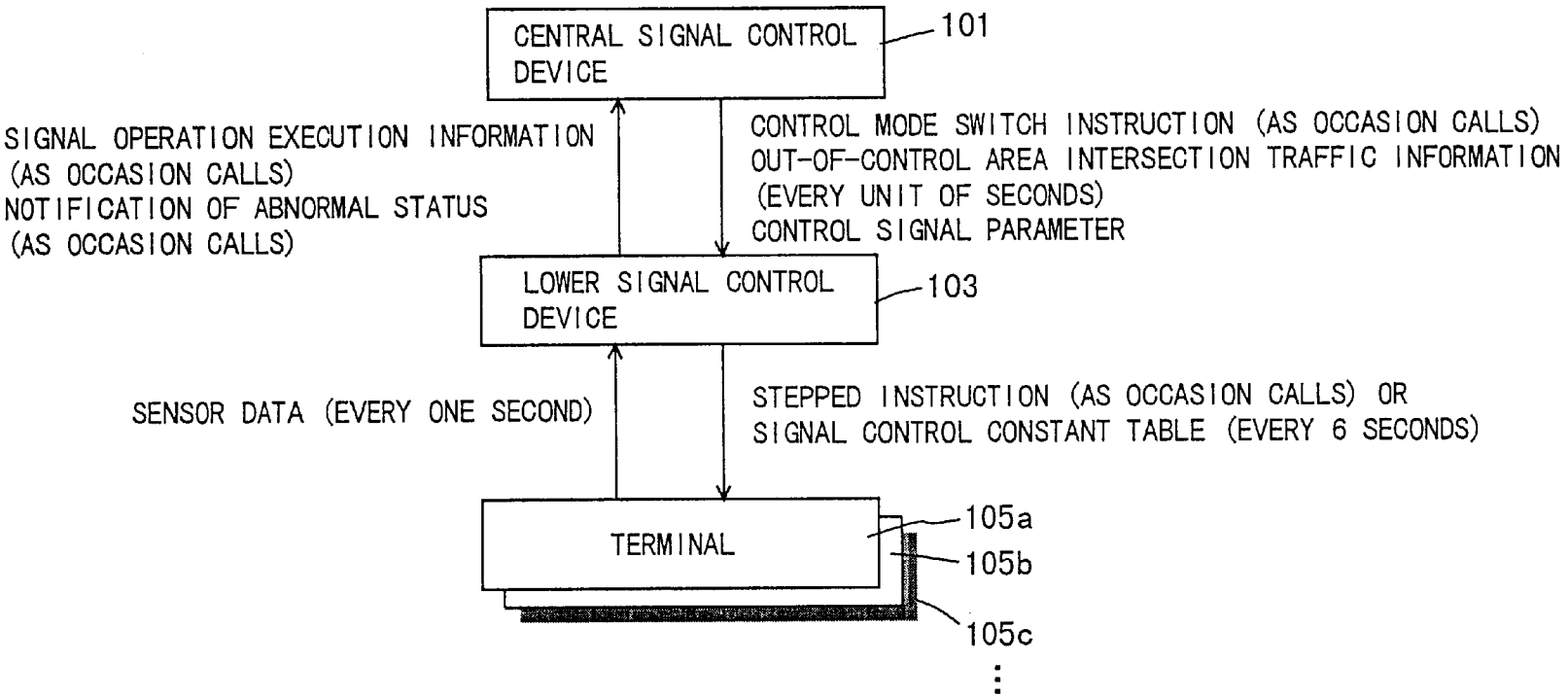
FIG. 2 is a block diagram showing a structure of a traffic signal control apparatus according to an embodiment of present invention.

FIG. 2 shows the principle of the structure of the system of the present embodiment. Referring to FIG. 2, the system includes a central signal control device 101, a lower order device 103, and a plurality of terminals 105*a* . . .

Central signal control device 101 transmits a control mode switch instruction, out-of-control area intersection traffic information, and signal control parameters to lower order device 103. Lower order device 103 transmits to each terminal 105*a* . . . a stepped instruction or a signal control constant table.

Terminal 105*a* is formed of a traffic light and a sensor. The data of the sensor is transmitted to lower order device 103 for every predetermined time (such as one second). Lower order device 103 transmits signal operation execution information and abnormal information to central signal control device 101.

Figure 3:
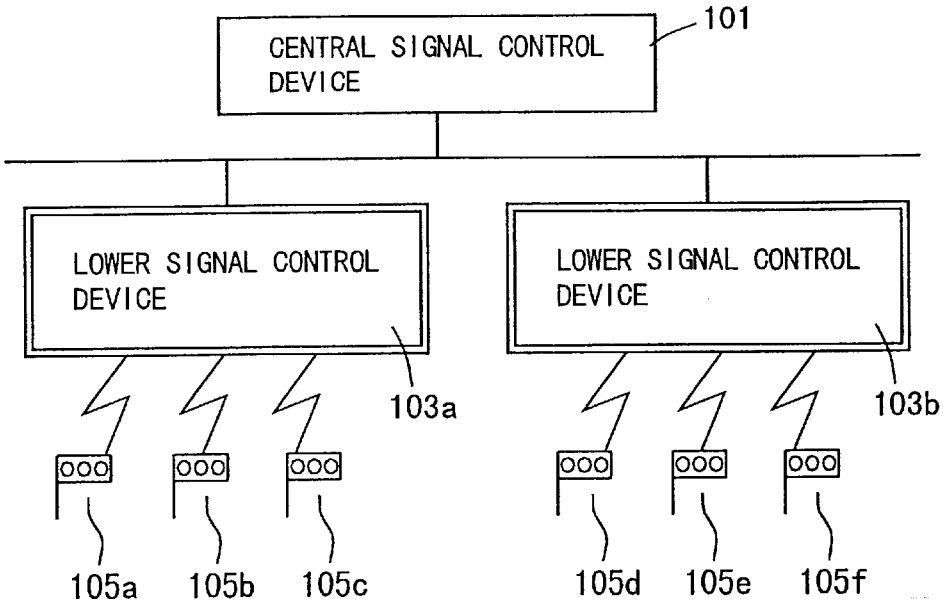
FIG. 3 is a block diagram showing a structure of a traffic signal control apparatus in further detail.

FIG. 3 is a block diagram showing a structure of the system of the present embodiment in further detail. Referring to FIG. 3, low order devices 103*a* and 103*b* are connected to central signal control device 101. Terminals 105*a*–105*c* and terminals 105*d*–105*f* are connected to lower order devices 103*a* and 103*b*, respectively.

Lower order devices 103*a* and 103*b* exchange traffic information and signal control contents between respective adjacent street intersections, whereby optimization of a signal control parameter is executed individually for each street intersection while maintaining the integrity of the entire network.

Lower order devices 103*a* and 103*b* optimize the signal control parameter (cycle, split, offset) calculated by central signal control device 101 that is already installed. Therefore, the signal control system that is already installed and the system of the present embodiment can be used in common. Lower order devices 103*a* and 103*b* execute the process for each sub area according to the operator's instruction, time, traffic sensed information, and the like. Also, switching to the conventional control can be effected easily, provided that the estimation of the traffic status (number of vehicles in the traffic jam) must be executed continuously even during execution of the conventional control.

Figure 4:
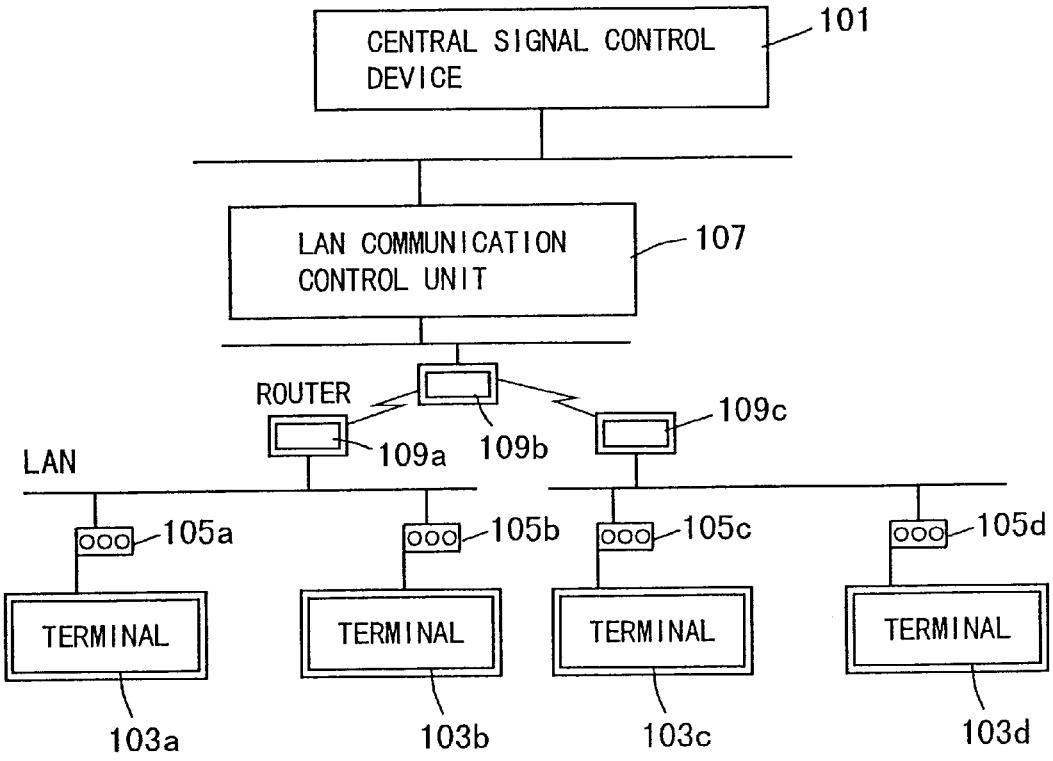
FIG. 4 shows a modification of the traffic signal control apparatus of FIG. 3.

FIG. 4 is a block diagram showing a modification of the structure of FIG. 3. The system may employ the centralized type as shown in FIG. 3 or the distributed type shown in FIG. 4. More specifically, a LAN (Local Area Network) communication control unit 107 is connected to central signal control device 101 of FIG. 4. A router 109*b* is connected to LAN communication control unit 107.

Lower order devices 103*a*–103*d* are connected to terminals 105*a*–105*d*, respectively. Terminals 105*a*–105*d* are connected to the LAN together with routers 109*a* and 109*c*.

By the communication between routers 109*a*–109*c*, a process similar to that of FIG. 3 can be carried out.

Figure 5:
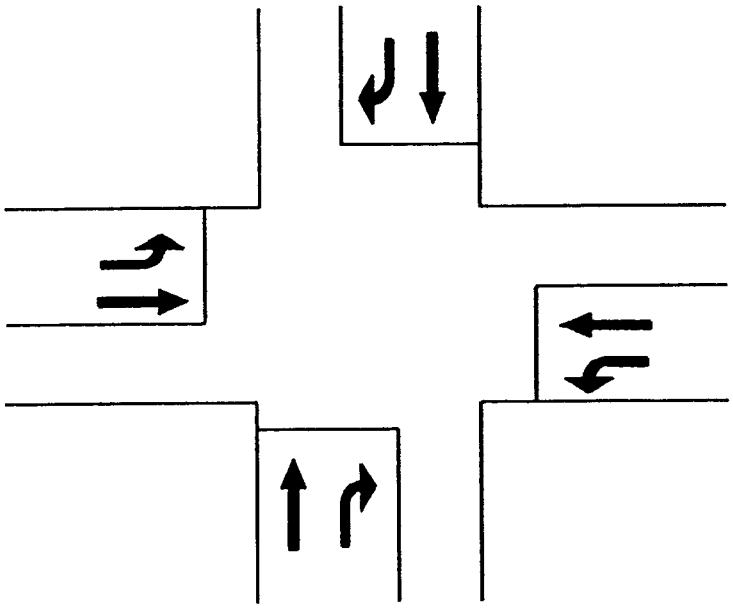
FIG. 5 is a plan view of a specific example of a street intersection.
Figure 6:
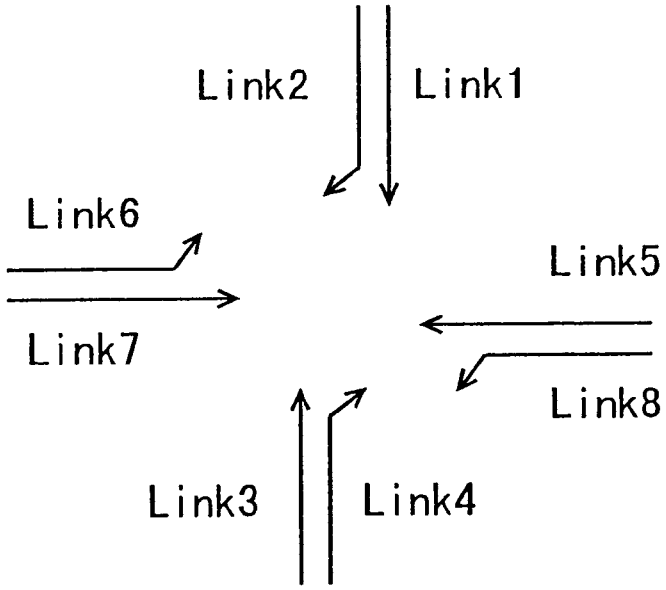
FIG. 6 shows the street intersection of FIG. 5 represented by links.

FIG. 5 is a plan view of one street intersection where a terminal is installed. FIG. 6 shows the assembly of links representing the street intersection of FIG. 5. At the street intersection as shown in FIG. 5, the straightforward lane, the right-turn lane and the left-turn lane are handled as independent links. Estimation of the traffic status is carried out at each link.

Figure 7:
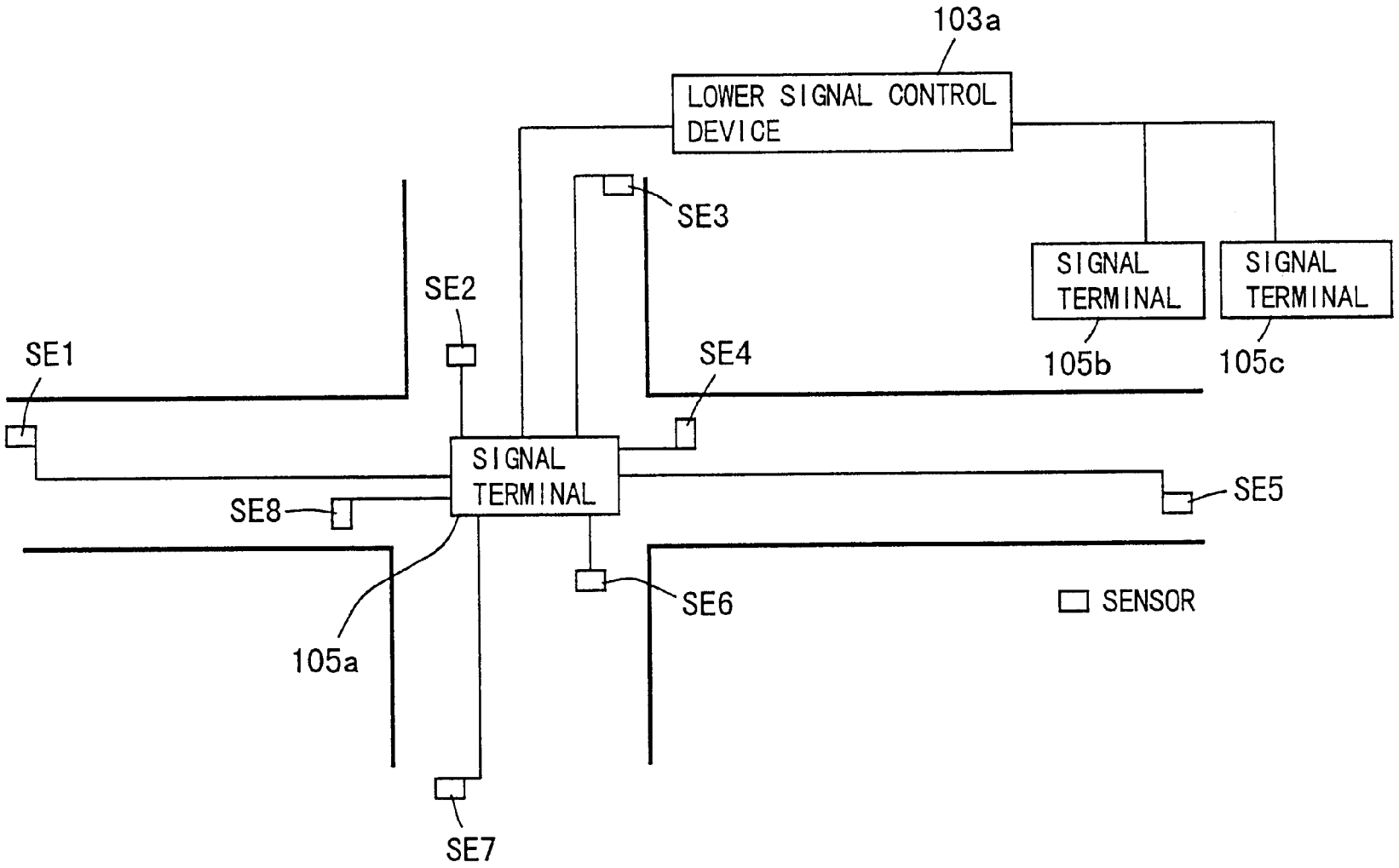
FIG. 7 is a plan view showing a structure of a signal terminal installed in the proximity of a street intersection.

FIG. 7 shows a structure of a street intersection where terminal 105*a* is installed. Terminal 105*a* is connected to lower order device 103*a*. Other terminals 105*b* and 105*c* are connected to lower order device 103*a*.

Terminal 105*a* includes sensors SE1–SE8 sensing vehicles at that street intersection. In the standard state, the traffic flow per unit of seconds is measured by a sensor installed closest to the entrance of each flow path. At least four sensors are required per street intersection. When there is a right-turn additional lane, it is desirable to install a sensor to measure the right-turn traffic volume at a spot upstream that additional lane.

In the system of the present embodiment, the processes of (1)–(6) below are carried out.

(1) Profile data generation (traffic information collection): The number of vehicles counted for every one second is arranged in the arriving order at the stop line based on vehicle data through the sensor.

(2) Signal control plan optimization: The signal control plan is designed according to the minimum/maximum restriction condition of the blue light time for every unit of seconds. The change in the traffic status when each signal control plan is executed is simulated, and the cost thereof calculated. The optimum signal control plan corresponding to the minimum cost is selected, and the signal control plan is updated according to the selected plan.

(3) Update of standard signal control parameter: The standard signal control parameter is updated according to the cycle length and the split which are calculated for every five minutes (or 2.5 minutes) at central signal control device 101.

(4) Traffic index update: The traffic index such as the branch rate, the number of vehicles in jam are estimated for every constant cycle. The traffic index is corrected by the measured information from another information collector device (such as an image sensor).

(5) Correction function: In order to prevent error accumulation, the number of vehicles in jam tam length) estimated by the system is corrected.

(6) Control mode selection: The control mode is switched according to instruction, time, traffic sensitivity and the like. Politic control giving the flow of traffic in a particular direction priority is carried out when determination is made of over-saturation.

Figure 8:
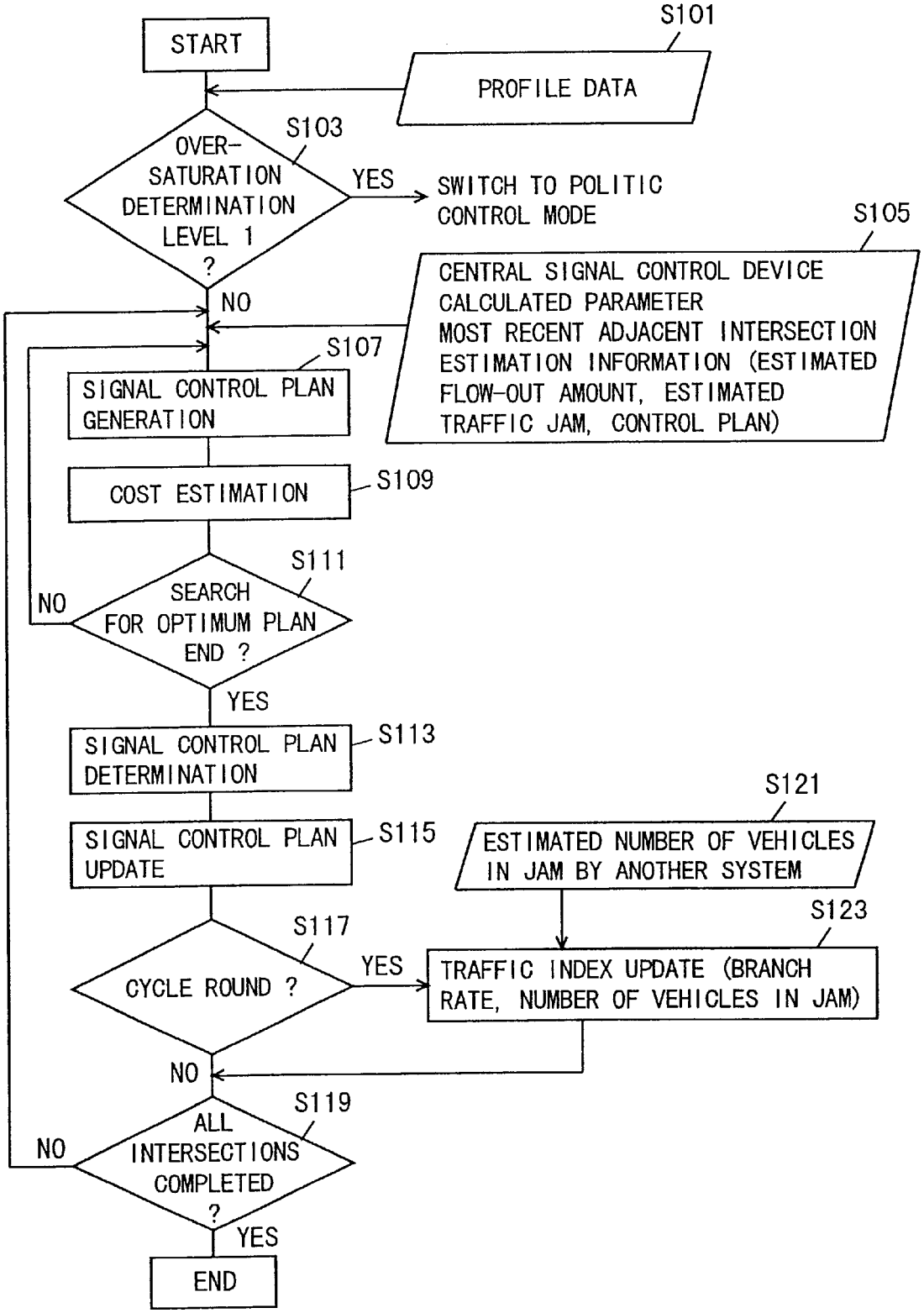
FIG. 8 is a flow chart to describe a traffic signal control process.

FIG. 8 is a flow chart showing the process executed for every unit of seconds in the present embodiment. Optimization of the signal control parameter is executed for every unit of seconds (here, six seconds).

At step S101, vehicle profile data is input to estimate the status of a street intersection. At step S103, the over-saturation status is determined. If level 1 is not exceeded, control proceeds to step S107. When determination is made of YES at step S103, the mode is switched to the politic control mode. Control giving priority to traffic of a particular direction is carried out.

At step S105, the parameter calculated by central signal control device 101 is input. Also, the estimated information (estimated flow-out amount, estimated traffic jam, control plan) of an adjacent street intersection is input.

At step S107, the plan controlling the traffic signal is generated. At step S107, estimation of the cost by that plan is carried out. At step S111, determination is made whether the search for the optimum plan has ended or not. The process of steps S107 and S108 is repeated until determination of YES is obtained.

When YES at step S111, control proceeds to step S113 to determine the signal control plan. At step S115, the signal control plan is updated. At step S117, determination is made of the cycle round (the timing from red→green or green→red). When NO, control proceeds to step S119 where determination is made whether update of the signal control plan has been completed for all the street intersections. The process from step S105 is repeated until YES at step S119.

When YES at step S117, the estimated number of vehicles in jam is input by another system (image processor or the like) at step S121. At step S123, the traffic index (branch rate or number of vehicles in jam) is updated. Then, control proceeds to step S119.

The process executed by the flow chart of FIG. 8 will be described in detail here.

(1) Generation of Vehicle Profile Data (S101)

The status at a street intersection is estimated according to data collected on a second-by-second basis from the sensor. More specifically, the timing of a vehicle from the traffic flow of the present to the future of several minutes arriving at the stop line of the street intersection is estimated using a traffic measurement device installed upstream the link and the expected flow-in traffic volume obtained from an upstream intersection.

Based on the assumption that the incoming vehicle in the traffic flow will run at the set speed, the data from the sensor is sorted in the time sequence expected to arrive at the stop line. The data is collected for every time step in the unit of one second. The traffic volume arriving from upstream the position where the sensor is installed is applied by the expected flow-out traffic volume information of the upstream intersection exchanged with the adjacent street intersection located upstream. Generation of the vehicle profile data is carried out according to the following steps ①–③.

Figure 9:
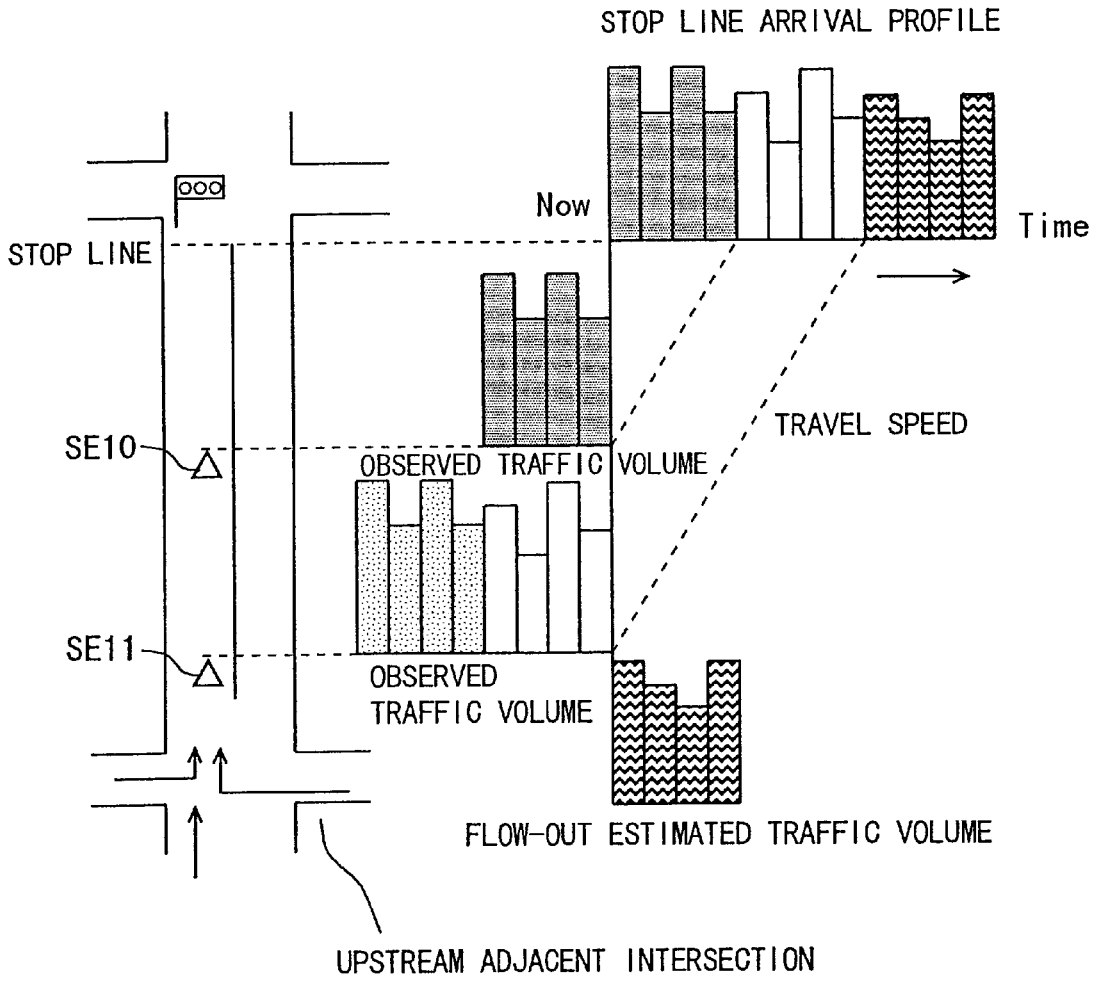
FIG. 9 is a diagram to describe the process of generating a vehicle stop line arrival profile.

① Referring to FIG. 9, the expected traffic flow per unit time is calculated according to the data (observed traffic volume) from sensors SE10 and SE11.

② The expected traffic flow per unit time is sorted according to the expected branch rate to generate a stop line arrival profile for each direction of travel.

③ At a link where a sensor is not installed, a vehicle arrival profile is estimated according to an upstream estimated flow-out profile.

Figure 10:
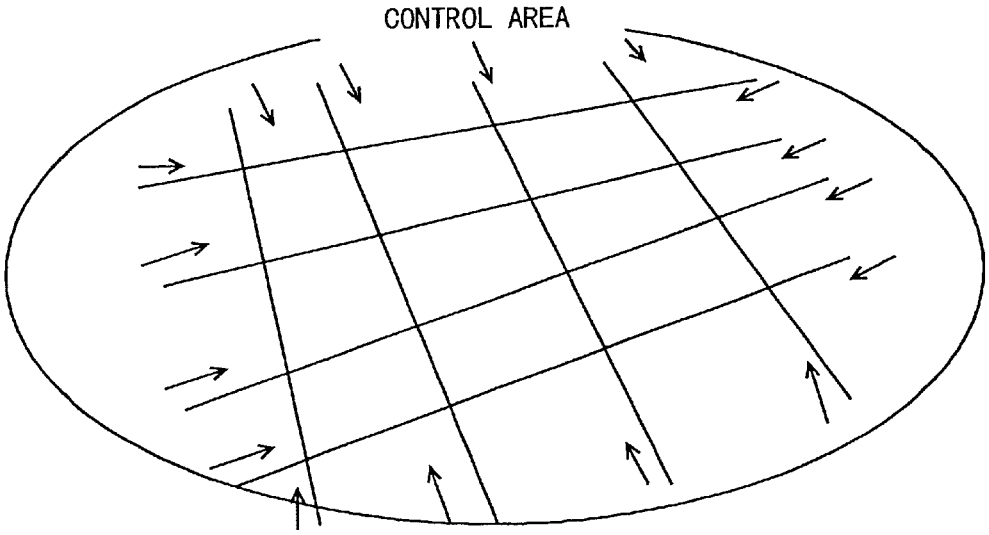
FIG. 10 is a diagram to describe links located at the edge of a control area.
Figure 13:
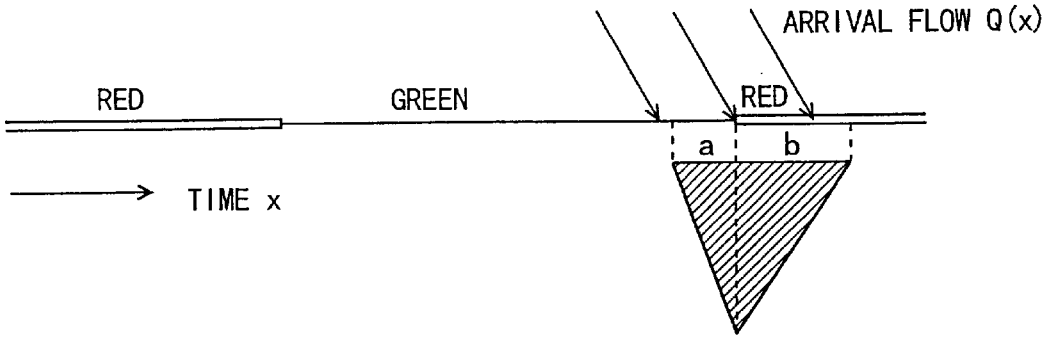
FIG. 13 is a diagram to describe the degree of risk.

At a link located at the edge of a control area where upstream intersection data is not obtained (the links indicated by the arrows in FIG. 10), the average traffic flow-in per unit time is employed as the required traffic volume of one preceding cycle. When the length of the traffic jam becomes so long that the flow-in traffic volume cannot be measured because the sensor is located in the traffic jam, a statistic value of the past is taken as the required traffic volume.

(2) Signal Control Plan Update (S115)

In each signal control plan, the plan with the lowest cost (PI) is employed as the signal control plan. This signal control plan is executed for only the next one step (for the unit of seconds), and the search for the optimum signal control plan is carried out again.

(3) Traffic Estimation Correction Function (S123)

In order to prevent accumulation of an error, the number of vehicles in jam (am length) is corrected. More specifically, at the timing of executing optimization, the flow-out traffic volume estimated at the previous optimization timing is compared with the traffic volume actually measured at the downstream link at the time zone where flow-out is expected to be measured based on the estimated flow-out traffic volume and the traffic light color information (traffic light color information history). The estimated traffic flow-out amount and the number of vehicles in jam are corrected according to the compared result. When the jam length can be measured by an image sensor, or when the jam length is calculated according to sensor information, the number of vehicles in jam is corrected based on this traffic jam length.

(4) Selection of Signal Control Mode

The control mode (signal control method) is selected according to the traffic condition (nonsaturation/near-saturation/over-saturation), abnormal status, or operator's instruction. The mode to be selected is set forth in the following.

① Split Optimization

The split is optimized under the condition of fixed cycle length and fixed offset. The variable to be determined is the split of each phase. This mode is mainly applied at an off-peak traffic status.

② Complete Automatic Optimization

The cycle, split and offset are generated automatically. The variable to be determined is the end timing of the present phase. This mode is employed when the traffic is at an off-peak status to a near-saturation status.

③ Over-saturation Control

When traffic jam occurs locally at some of the links, the following measures are taken to increase the link flow-out amount. First, the green light time maximum restriction is alleviated. When the relevant link corresponds to a traffic jam and the destination link does not correspond to a traffic jam at an arbitrary time of estimation, the OutDelay cost of the flow-out traffic to that link is set to 0. In other words, when there is an excessive traffic jam locally at some links, the green light time maximum restriction is alleviated and the weight coefficient of the downstream delay (the delay of the flow-out traffic flow expected at the flow-out destination) which is one cost element is set to 0 to expedite the processing amount of that link.

More specifically, when there is traffic demand exceeding the intersection processing ability, control is switched to politic traffic jam control to execute priority control such as increasing the green light time of a particular direction. Alternatively, a signal control plan with the maximum intersection processing traffic volume in the estimated range is executed with the control target corresponding to the maximization of the handling amount.

④ Environment control

Control is executed aiming to reduce traffic noise and gaseous emission which are the major pollution. Noise reduction control is realized by maximizing the weight coefficient of the noise cost mainly during the time when in an off-peak traffic status or during the night. Similarly, gaseous emission control is realized by maximizing the weight coefficient of the gaseous emission cost.

⑤ Currently Available Control

When necessary, control is executed with the standard phase length calculated by control currently available when in an abnormal status or the like.

(5) Traffic Index Estimation (S105)

Branch rate information or the like is updated for each cycle based on the profile data and the signal control history information of the flow-out destination link. The straight ahead/right-turn/left-turn traffic volume is estimated by the sensor information of the flow-out destination for the phase capable of flow-out to the target direction of several cycles in the past. When traffic information estimated by another system such as an image sensor can be obtained, the estimation information is corrected according to that exchanged information.

(6) Update of Standard Phase Length (S105)

Each standard signal control parameter is updated by the cycle and split calculated by the central signal control device that is currently available. The signal control plan is generated according to the standard signal control parameter.

(7) Accumulation of Control History

The signal control history is transmitted to the central signal control device for each cycle. The signal control history is accumulated at the central signal control device.

(8) Control Switching

Switching is carried out between the control of the system of the present embodiment and control that is currently available according to a switch instruction of the control. When intervention is to be effected, control is switched to the existing control to use the conventional function.

(9) Abnormal Processing

Abnormal information such as abnormality in the terminal is notified to the central signal control device.

The process carried out at steps S107–S113 of FIG. 8 will be described in detail hereinafter.

Figure 11:
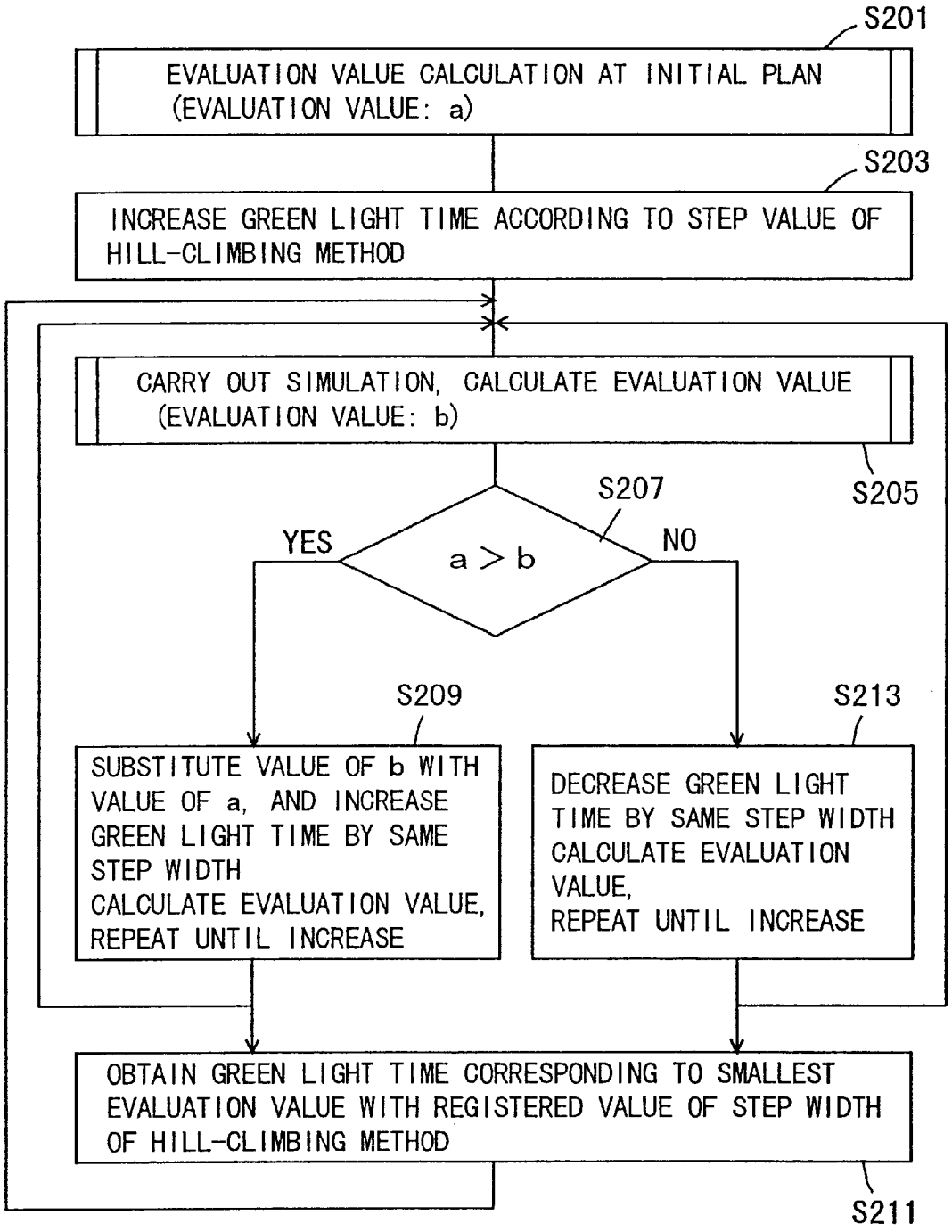
FIG. 11 is a flow chart of the method of searching for an optimum plan.

FIG. 11 is a flow chart of a signal control plan determination process. In the present embodiment, the processing time of searching for the optimum plan is reduced using the hill-climbing method.

At step S201, an evaluation value a is calculated by the initial plan. At step S203, the green light time is increased according to the step value of the hill-climbing method. At step S205, an evaluation value b is calculated by simulation.

At step S207, determination is made whether a>b. When YES, control proceeds to step S209 to replace the value of b with the value of a, and the green light time is increased by the same step width. Then, the evaluation value is calculated again. The process from step S205 is repeatedly executed until the evaluation value increases. If the evaluation value has increased at step S209, control proceeds to step S211 to obtain the green light time value corresponding to the value registered as the step width of the hill-climbing method and the smallest evaluation value.

When NO at step S207, control proceeds to step S213 to reduce the green light time by the same step width and calculate the evaluation value. The process from step S205 is repeated until the evaluation value increases. If the evaluation value has increased at step S203, control proceeds to step S211.

In the present embodiment, a signal control plan over the horizon of 150 seconds is produced as the plan of signal control. For the present phase, the signal control plan is designed in the range from the lowest restriction to the largest restriction. The standard current light representation length is set for the current light representation length succeeding the horizon of the estimation range (150 seconds). The traffic status change of a street intersection for every unit of seconds when each control plan is executed is simulated, and the cost of the entire horizon of 150 seconds is calculated. The cost is established as the formation of a weighted linear sum. The plan with the lowest cost is employed as the execution control plan of the next step.

Figure 12:
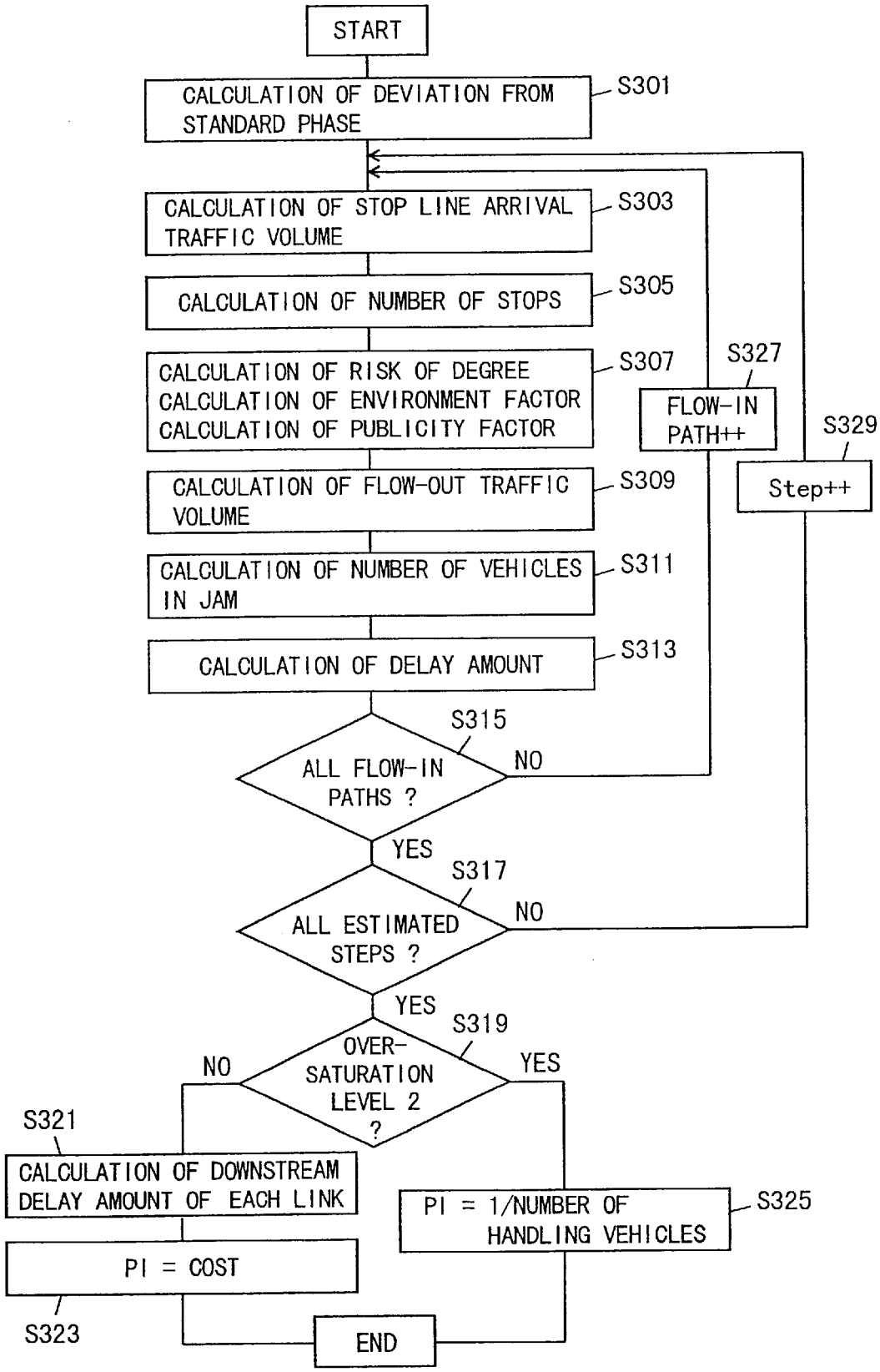
FIG. 12 is a flow chart representing the method of calculating an evaluation value.

FIG. 12 is a flow chart of an evaluation value (cost) calculation process executed at step S201 or S205 of FIG. 11.

At step S301, deviation from the standard phase length is calculated. At step S303, the stop line arrival traffic volume in the generated plan is calculated. At step S305, the number of stops is calculated. At step S307, the degree of risk, environment factor and publicity factor are calculated. At step S309, the flow-out traffic volume is calculated. At step S311, the number of vehicles in the jam is calculated. At step S313, the delay amount is calculated.

At step S315, determination is made whether the process has been carried out for all the flow-in paths. When NO, the flow-in path is changed at step S327, and the process from step S303 is repeated.

When YES at step S315, control proceeds to step S317 to determine whether the entire estimation steps have been completed or not. When NO, control proceeds to step S329 to advance to the next step. The process from step S303 is repeated.

When YES at step S317, control proceeds to step S319 to determine whether the over-saturation status corresponds to the level of 2 or more When YES, control proceeds to step S325 to employ one of the over-saturation state for the calculation equation of the evaluation value.

When NO at step S319, the downstream delay amount of each link is calculated at step S321. At step S323, calculation of an evaluation value in a nonsaturated state is carried out.

At step S319, the control target is switched to maximization of the handling amount (S325) when determination is made that the expected traffic status index (degree of saturation) has exceeded the threshold value of 2 and is in an over-saturation status (when traffic demand exceeding the street intersection processing ability has flown in). When the expected traffic status index (degree of saturation) exceeds threshold value 1, the control mode is switched to the priority control of a particular direction (YES at step S103 of FIG. 8). Weight coefficients w1–w7 of each cost element is modified arbitrarily according to the region characteristics, traffic status and control target. Control applying weight on the main road side can be carried out by setting the link weight coefficient.

The equation to calculate evaluation value PI in the control (S323) where the degree of saturation does not exceed threshold value 2 and control (S325) when the degree of saturation exceeds 2 is shown in the following (1) and (2), respectively.

Nonsaturation (PI minimization)

$$PI=\Sigma Li\times(w1\times Delay+w2\times Stop+w3\times OutDelay)+w4\times DangerousFactor+w5\times EnvironmentFactor+w6\times PublicFactor+w7\times Dev \quad (1)$$

Over-saturation (PI minimization)

$$PI=1/wx\times Outgo \quad (2)$$

Here;

Li: link weight coefficient

Wn: weight coefficient of each cost element n

Delay: intersection delay amount (vehicle · second)

Stop: number of stops (times) (number of vehicles arriving at stop line during red light time)

OutDelay: expected delay value at connecting downstream link (vehicle · second)

DangerousFactor: degree of traffic accident risk

EnvironmentFactor: environment element

PublicFactor: publicity factor

Outgo: number of vehicles handled (vehicles)

Information used in the calculation of an evaluation value will be described here.

(1) Stop Line Arrival Traffic Volume Estimation

The flow-in traffic volume is estimated of a vehicle from the flow-in traffic arriving at the stop line for each step in units of seconds. The flow-in traffic volume is the normalized value of stop line arrival profile information generated on the basis of upstream sensor information. As to the traffic volume flowing in from upstream the sensor position of the most upstream link, the area boundary link (when in traffic jam where sensor information cannot be collected: statistic value) (non-jam: average value of prior cycle) is employed. As to the internal link, the expected flow out traffic volume of the upstream intersection is taken as the flow-in traffic volume.

Stop line arrival traffic volume (number of vehicles arriving at stop line) is calculated by equation (3).

$$Income\ (t)=(1-\alpha)\times Profile\ (t-arrive)+\alpha\times Profile\ (t-1-arrive) \quad (3)$$

t: step

α: normalized coefficient arrive: number of steps from sensor position to stop line arrival Income (t): number of vehicles arriving at stop line at step t Profile (t): sensor collection profile data at step t (2) Flow-out Traffic Volume Estimation The flow-out traffic volume for every unit of seconds is estimated by the signal light color information and saturation flow amount. When the number of vehicles in the jam at the estimated time point exceeds the downstream link capacitance at the downstream link, the number of flow-out vehicles to the downstream link is set to 0. When there is a traffic volume that can flow-out to the link that is subject to conflict under the conflict condition, the number of vehicles flowing towards the relevant direction of travel is set to 0.

$$Outgo\ (t)=minimize\ (Q\ (t)+Income\ (t),\ \alpha\times SF) \quad (4)$$

Outgo (t): number of vehicles flowing out at step t

Q (t): number of vehicles in jam at step t

Income (t): number of vehicles arriving at stop line at step t

SF: saturation flow amount (vehicles/second)

α: lane block correction coefficient (3) Number of Vehicles in Jam (Jam Length) Estimation The number of vehicles in jam for every units of seconds is estimated for each link by the following equation (5).

$$Q\ (t+1)=Q\ (t)+Income\ (t)-Outgo\ (t) \quad (5)$$

Q (t): number of vehicles in jam at time t

Income (t): number of vehicles arriving at stop line at time t

Outgo (t): number of vehicles flowing out at time t (4) Delay Amount Calculation The delay amount by the calculated number of expected vehicles in jam is calculated by equation (6).

$$\text{Delay}=\Sigma Q(t) \tag{6}$$

(5) Delay Amount Calculation of Downstream Link

The amount of delay that the vehicle out from the link receives at the downstream link over the horizon of 150 seconds is estimated by the downstream link signal light color information and traffic information, similar to the case of the current link.

(6) Number of Stops

The number of vehicles arriving at the stop line when the signal light is at the red time zone is set as the number of stops.

(7) Degree of Risk

The possibility of a traffic accident is increased at the time zone where the signal color light is switched from green to red. This is because the slight delay in the determination of whether to stop or pass through causes vehicles to stop by hitting the breaks or vehicles squeezing through the intersection to result in rear-end collision or bumping.

In order to reduce the number of vehicles passing during this time zone of high degree of risk, the number of vehicles arriving at the stop line in the time zone is defined as the degree of risk by equations (7) and (8). The time point when the traffic light is turned to red is t.

calculation ($t-a \leqq x \leqq t$) of risk of degree right before blue light end (time ti)

$$\text{DangerousFactor}=1/a\times\int\{x-(t-a)\}\times Q(t)\,dx \tag{7}$$

calculation ($t \leqq x \leqq t+b$) of risk of danger right after red light start (time ti)

$$\text{DangerousFactor}=1/b\times\int\{(t+b)-x\}\times Q(x)\,dx \tag{8}$$

(8) Environment Factor

Traffic noise is the typical traffic pollution. This noise is noticeable when a vehicle starts moving or at the time of acceleration. The environment factor is introduced as the cost element in order to let large type vehicles and vehicles of poor maintenance that are the sources of noise pass through promptly without stopping at the intersection to suppress noise generation caused by start and acceleration operation of a vehicle. A noise profile is generated by the information of a noise sensor. It is assumed that the group of noise-generating vehicles run at the measured or set speed. The measured noise value when the noise-generating vehicle group arrives at the stop line at the red signal is set as the noise cost. Cost is similarly applied using a gaseous emission profile obtained by a gaseous emission sensor for the gaseous emission.

$$\text{EnvironmentFactor}=wa\times\text{Noise}+wb\times\text{Gas} \tag{9}$$

Noise: noise value

Gas: density of gaseous emission (9) Publicity Factor

This factor is to apply priority on public transportation such as buses. More specifically, the timing of a bus arriving at a stop line is estimated by the data of a bus sensor. The number of buses arriving at the stop line when the traffic signal is in the red light time zone is applied as the cost element. Accordingly, priority can be given to buses while balancing with the entire delay.

(10) Deviation from Standard Phase Length

In order to maintain integrity between intersections in the same sub area, the difference between the control plan and the standard current light representation length is applied to the cost element.

Accordingly, signal control can be realized taking into consideration individually or simultaneously factors such as reducing the risk of danger of a traffic accident, reducing influence to the environment, the number of stops at the signal by public transportation such as buses.

Figure 14:
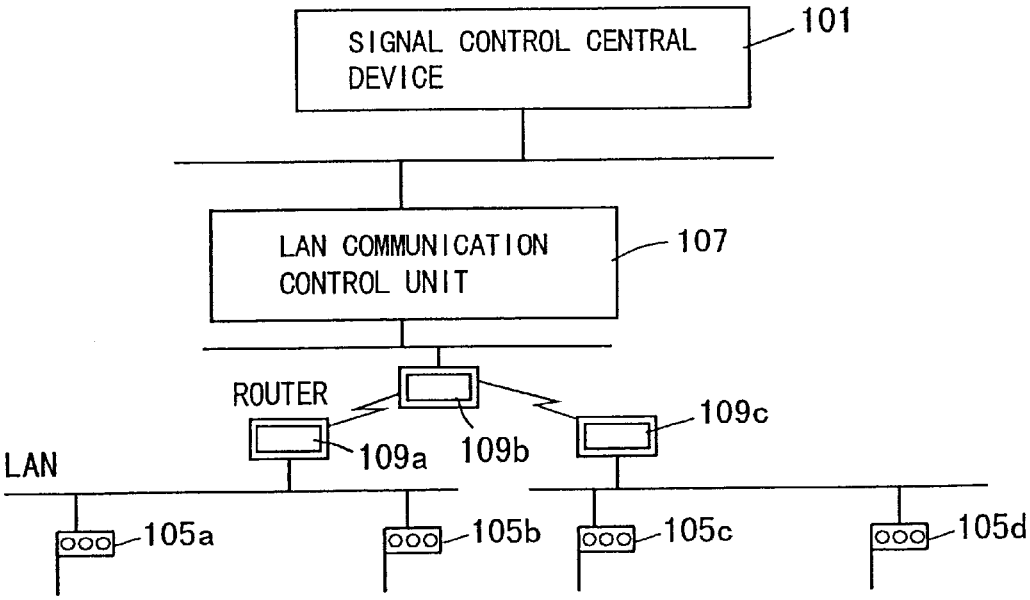
FIG. 14 shows a modification of FIG. 4.

The device shown in FIG. 4 may be configured as shown in FIG. 14. The device of FIG. 14 has terminals 105*a*–105*d* connected together with routers 109*a* and 109*c*. Terminals 105*a*–105*d* per se carry out a process similar to those by lower order devices 103*a* and 103*b* to optimize the signal control parameter in the configuration of FIG. 14.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A traffic signal control apparatus comprising:

a collector unit collecting traffic information through a sensor provided at a road, and an optimization unit predicting change in traffic status from the present to the future to optimize a signal control parameter according to a rolling horizon scheme, wherein a collect cycle of said traffic information and a cycle of said optimization can be defined independently, and the cycle of said optimization is set variable according to a cycle of signal control or the traffic status.

2. The traffic signal control apparatus according to claim 1, wherein optimization of a signal control parameter is executed individually for each street intersection while maintaining integrity with an entire network by exchanging traffic information and signal control contents between adjacent street intersections.

3. The traffic signal control apparatus according to claim 2, further comprising a portion estimating timing of a vehicle from a traffic flow from the present to the future arriving at a stop line using a traffic flow measurement unit installed upstream a link and an estimated flow-in traffic flow amount obtained from an upstream intersection.

4. The traffic signal control apparatus according to claim 3, having a function to realize signal control taking into consideration individually or simultaneously reduction in risk of danger of a traffic accident, influence to an environment, and reduction of stops at a signal of a bus and other public transportation.

5. The traffic signal control apparatus according to claim 4, having a self correction function to correct estimated flow-out amount according to a relationship between history of a traffic signal light color and traffic volume measured by a traffic flow measurement device of a flow-out destination link.

6. The traffic signal control apparatus according to claim 5, having a function to correct an estimated traffic jam length according to a jam length measured by an image sensor or a jam length calculated from traffic information obtained by the traffic flow measurement device.

7. The traffic signal control apparatus according to claim 6, having a function to alter a weight coefficient of each cost element of an evaluation function of a signal control parameter according to traffic status, region characteristics and control target.

8. The traffic signal control apparatus according to claim 7, having a function to switch the control target from cost minimization to handling amount maximization, or to switch to priority control giving priority to a particular direction when traffic demand exceeding intersection processing ability flows to a street intersection.

9. The traffic signal control apparatus according to claim 8, having a function to, when excessive traffic jam occurs locally at some links, expedite a processing amount by said some links by alleviating a blue light time maximum restriction and setting a weight coefficient of downstream delay which is one cost element to 0.

10. The traffic signal control apparatus according to claim 9, including a portion to switch a signal control method according to traffic status of nonsaturation, near-saturation and over-saturation, in an abnormal status, or in response to an instruction.

11. The traffic signal control apparatus according to claim 1, further comprising a portion estimating timing of a vehicle from a traffic flow of the present to the future arriving at a stop line using a traffic flow measurement unit installed upstream a link and an estimated flow-in traffic flow amount obtained from an upstream street intersection.

12. The traffic signal control apparatus according to claim 1, having a function to realize signal control taken into consideration individually or simultaneously reduction of risk of danger of a traffic accident, influence to an environment, and number of signal stops of a bus and other public transportation.

13. The traffic signal control apparatus according to claim 1, having a self correction function to correct an estimated flow-out amount according to a relationship between history of a traffic signal light color and a traffic volume measured by a traffic flow measurement device of a flow-out destination link.

14. The traffic signal control apparatus according to claim 1, having a function to correct an estimated traffic jam length according to a jam length measured by an image sensor or a jam length calculated from a traffic information obtained by a traffic flow measurement device.

15. The traffic signal control apparatus according to claim 1, having a function to alter a weight coefficient of each cost element of an evaluation function of a signal control parameter according to traffic status, region characteristics and control target.

16. The traffic signal control apparatus according to claim 1, having a function to switch the control target from cost minimization to handling amount maximization, or to switch to priority control giving priority to a particular direction when traffic demand exceeding intersection processing ability flows to a street intersection.

17. The traffic signal control apparatus according to claim 1, having a function to, when excessive traffic jam occurs locally at some links, expedite a processing amount by said some links by alleviating a blue light time maximum restriction and setting a weight coefficient of downstream delay which is one cost element to 0.

18. The traffic signal control apparatus according to claim 1, including a portion to switch a signal control method according to traffic status of nonsaturation, near-saturation and over-saturation, in an abnormal status, or in response to an instruction.

* * * * *